United States Patent [19]

Mikulecky

[11] Patent Number: 4,818,967

[45] Date of Patent: Apr. 4, 1989

[54] FUSED HIGH VOLTAGE BUSHING

[75] Inventor: Harvey W. Mikulecky, Oconomowoc, Wis.

[73] Assignee: Cooper Power Systems, Inc., Houston, Tex.

[21] Appl. No.: 115,504

[22] Filed: Oct. 30, 1987

[51] Int. Cl.[4] ..... H01H 85/02

[52] U.S. Cl. ..... 337/202; 337/159; 337/204; 337/295

[58] Field of Search ..... 337/202, 203, 204, 290, 337/291, 293, 294, 158–166, 295; 29/623

[56] References Cited

U.S. PATENT DOCUMENTS

| | | | |
|---|---|---|---|
| 3,633,141 | 1/1972 | Ristaccia | 337/224 |
| 3,648,211 | 3/1972 | McKeithan | 337/202 |
| 3,911,385 | 10/1975 | Blewitt et al. | 337/202 |
| 3,921,116 | 11/1975 | Mikulecky | 337/202 |
| 4,001,748 | 1/1979 | Salzer | 337/159 |

*Primary Examiner*—H. Broome

*Attorney, Agent, or Firm*—Nelson A. Blish; Eddie E. Scott; Alan R. Thiele

[57] ABSTRACT

A current limiting fuse for a transformer bushing including a glass tubing, an elongate ribbon spirally wound in the tubing, the ribbon including a number of tabs formed integral therewith to space the ribbon inwardly of the walls of the tubing, a terminal stud mounted on one end of the tubing and being electrically connected to the ribbon, a conductive rod connected to the other end of the ribbon and sealed in the other end of the tubing, a granular dielectric material completely filling the tubing, a self-sealing, self-bonding, rubber tape wrapped around the outside of the tubing and a glass reinforced tape wrapped around the outside of the rubber tape.

16 Claims, 2 Drawing Sheets

FUSED HIGH VOLTAGE BUSHING

BACKGROUND OF THE INVENTION

Bushings having current-limiting fuses mounted therein generally consist of a spider axially aligned in a passage in the bushing with a fusable element spirally wrapped around the spider. The passage is then filled with a granular, dielectric material such as sand. Typical of this type of structure is shown in U.S. Pat. No. 3,633,141, issued on Jan. 4, 1972, and entitled "Electrical Bushing Assembly"; U.S. Pat. No. 3,913,050, issued on Oct. 14, 1975, and entitled "Fuse Assembly for Current-Limiting Fuses"; and U.S. Pat. No. 3,648,211, issued on Mar. 7, 1972, and entitled "High Voltage Current-Limiting Protective Device." In each of these patents the current-limiting fuse ribbon is mounted on a spider located within the bushing. On interruption of the fuse, the bushing is subjected to thermal shock which often cracks the bushing.

In U.S. Pat. No. 3,911,385, issued on Oct. 7, 1985, and entitled "Outdoor Current-Limiting Fuse," a fuse structure is shown which includes a casing or tube 12 having terminal end caps and a plurality of fusable elements extending between the end caps. The fusable elements being shown in the form of wires which are suspended in the granular dielectic material. In this type of structure, difficulties have occurred in filling the tube with the granular material since the wires cannot be observed and it is not known whether the wires have shifted during filling. If the wires are too close to the walls of the housing or collapse upon each other, short circuits can occur within the fuse housing.

SUMMARY OF THE INVENTION

In the present invention, the fuse assembly is provided with an unsupported fusable element or ribbon that has integral tabs that provide spacing between the fusable ribbon and the inner walls of the housing. The fuse element is in the form of an electrically conductive metallic ribbon which is initially spirally wrapped on a temporary mandrel shaft that is inserted into the housing. The mandrel shaft is removed from the housing to allow the spiral ribbon to expand radially so that the tabs engage the inner walls of the housing. A uniform spacing is thereby provided between the spirally wound ribbon and the walls of the tubing, the tubing then being filled with the granular refractory material.

One of the principal features of the invention is the provision of a one-piece electrically conductive ribbon having integral spacing tabs which is mounted in the housing and biased outwardly to engage the tabs with the inner walls of the housing to minimize flash over. This construction is simpler than known construction and provides for uniform spacing between the spiral windings and the inner walls of the tubing.

Another feature of the invention is the use of a resilient self-bonding tape to provide a gas tight seal around the tubing in the event of a crack occurring in the tubing.

A further feature of the invention is the provision of a reinforcing tape around the tubing to increase the burst strength of the tubing and thereby prevent release of gases on interruption.

Another feature of the invention is the method for making a fuse assembly for a high voltage bushing. The method is simple and yet provides the above-described improved ribbon structure.

Another feature of the invention is the use of a glass housing so that the spacing of the sprial winding can be observed during manufacture of the fuse thereby minimizing the possibility of short circuit paths existing between the windings at the time of manufacturing.

Other principal features and advantages of the invention will become apparent to those skilled in the art upon review of the following detailed description, claims and drawings.

Figure 1:
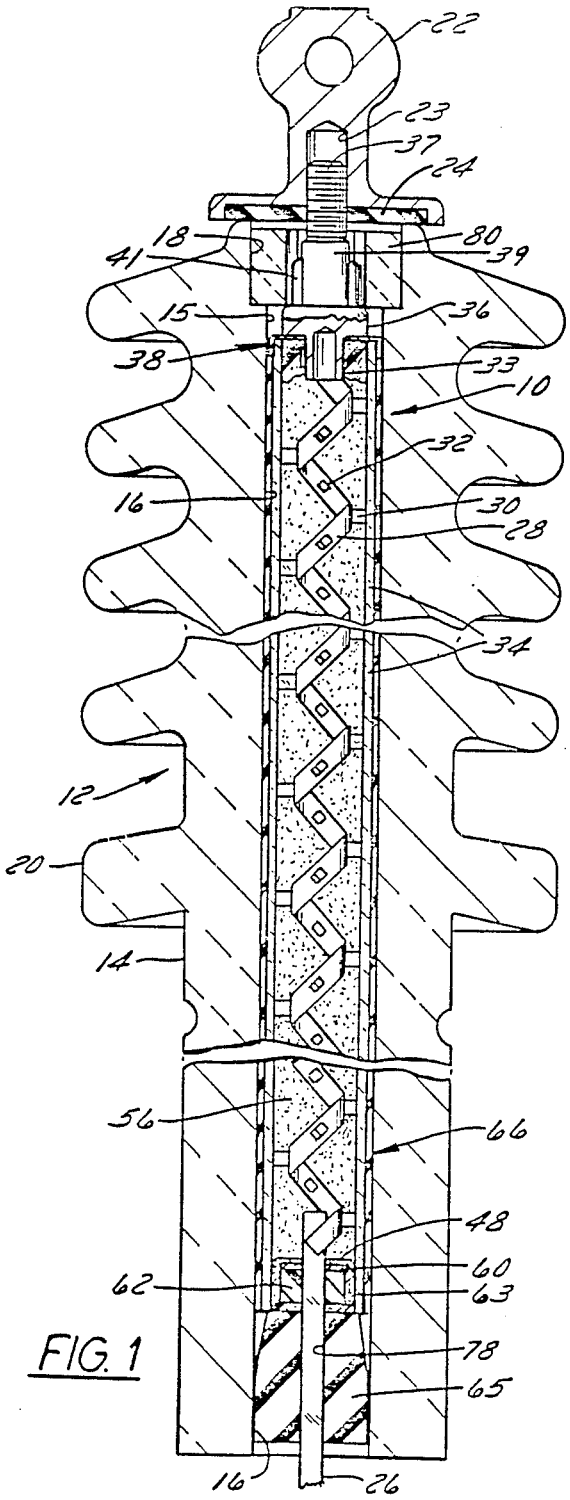
FIG. 1, is a cross-sectional view in elevation of a high voltage bushing having a fuse assembly mounted thereon.
Figure 4:
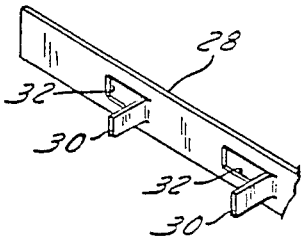
FIG. 4 is a perspective view of a portion of the ribbon showing the spacing tabs.

Before one embodiment of the invention is explained in detail, it is to be understood that the invention is not limited in its application to the details of construction and the arrangement of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DETAILED DESCRIPTION OF THE INVENTION

As seen in FIG. 1 of the drawings, the fuse assembly 10 is shown mounted in a high voltage bushing 12 of the type which is mounted on a housing or casing to connect a high voltage cable to an electrical apparatus such as a transformer or switchgear located within the housing or casing. The bushing 12 includes a dielectric housing 14 having an axially extending passage 16 which terminates at one end at a counterbore 18. The housing 14 can be formed from any of a number of ceramic dielectic materials such as porcelain or glass. These materials must be capable of withstanding the normal operating temperature of a high voltage bushing. A mounting flange 20 is provided on the outer surface of the housing 14 intermediate the ends. An electrically conductive coating 15 is provided on the surface of the passage 16 from the top down to approximately two inches from the bottom of the passage.

The bushing 12 is connected to a high voltage cable by means of an electric terminal 22 provided on the upper end of the bushing. The terminal 22 includes a threaded bore 23 and is seated on and closes the counterbore 18 in the upper end of the housing 14. The terminal 22 is sealed by means of a rubber gasket 24. The bushing 12 is connected to the electrical apparatus by means of an electrically conductive rod 26 mounted in the lower end of passage 16 in the housing 14.

Fuse Assembly

The fuse assembly 10 includes a self-supporting ribbon 28 having a number of tabs 30 punched out of the ribbon at equally spaced intervals leaving holes 32. The ribbon 28 is formed from electrically conductive metallic material such as silver or copper and is sufficiently resilient to be wound in a spiral. The ribbon 28 is mounted within a glass tubing 34 preferably made of Pyrex glass which has high temperature withstand capabilities, is nongasing and transparent. One end of the ribbon 28 is soldered to a boss 33 provided on a terminal stud 36 and the other end is soldered to the electrically conductive rod 26. The terminal stud 36 includes a connecting post 39 having a threaded section 37 at the end and a pair of flanges or keys 41 on opposite sides of the post 39. A bore 35 is provided in the boss 33.

Figure 5:
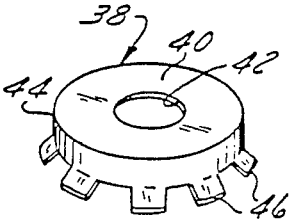
FIG. 5 is a perspective view of the centering cup for the bushing contact.
Figure 7:
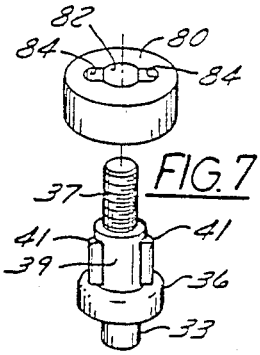
FIG. 7 is a perspective view of the key plug and connecting post.

The terminal stud 36 is centered in the tubing 34 by means of a centering cup 38 as shown in FIG. 5. In this regard, the centering cup 38 is formed from a circular plate 40 having a center opening 42 and an annular flange 44 having an inside diameter substantially equal to the outside diameter of the tubing 37 to provide a snug fit. A plurality of fingers 46 are provided around the edge of the flange 44 to provide electrical contact with the electrically conductive surface 15 on the internal surface of the passage 16 in the bushing to provide an equal potential across the fuse assembly when positioned in the bushing. The cup 38 is soldered to the stud 36.

Figure 6:
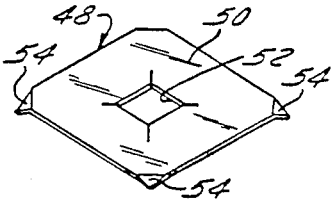
FIG. 6 is a perspective view of the metal washer for the fuse rod.

The rod 26 is centered in the tubing 34 by means of a square spring metal washer 48, as shown in FIG. 6. The washer 48 is formed from a square piece of spring metal 50 and has a square center opening 52 through which the rod 26 extends. The corners 54 of the washer are bent to allow for the washer to be inserted into the tubing 34. The fuse assembly is filled with a granular dielectic material such as sand 56 through the spaces between the edges of the washer 48 and the inner surfaces of the tubing 34, as described hereinafter. A paper disk 60 is positioned on the surface of the washer 48 to seal the sand in the tube temporarily.

The rod 26 is centered in the washer 48 and supported therein by means of a spacer 62 and a room temperature vulcanizing (RTV) seal material 64 which is inserted with the spacer 62 into the end of the tube 34 to permanently seal the rod 26 granular material in the tubing. The spacer 62 adds rigidity to both the rod 26 and the RTV seal 63.

Means are provided for sealing the outside surface of the glass tubing. Such means is in the form of a gas-tight covering 66 formed by a layer of self-bonding, self-fusing silicone rubber rape. The tape 64 is spirally wrapped around the outer surface of the tube 34 in an overlapping relation. The tape 64 maintains essentially a gas-tight covering even if the Pyrex breaks when the fuse is pressurized in the interrupting mode. A tape found suitable for this purpose is MOX-Tape 600-T Series tape made by Moxness Products, Inc. of Racine, Wis.

Means are also provided to increase the burst strength of the tube 34 to prevent any ballooning of the silicone rubber covering 66. Such means is in the form of a unidirectional glass reinforced adhesive tape 68 which is spirally wrapped around the outer surface of the covering 66. A thermal barrier may be provided around the covering 66 to minimize thermal shock of the bushing. A flexible sheet of low thermal conductive material, such as "ceramic paper" may be used.

Method of Assembly

Figure 2:
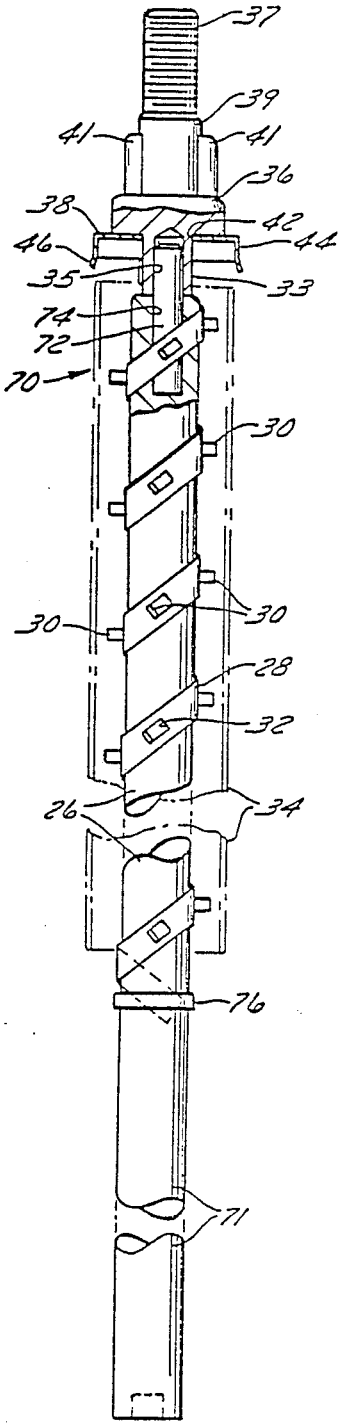
FIG. 2 is a view of the ribbon element shown spirally wrapped on a mandrel shaft and ready for insertion into the glass tubing.
Figure 3:
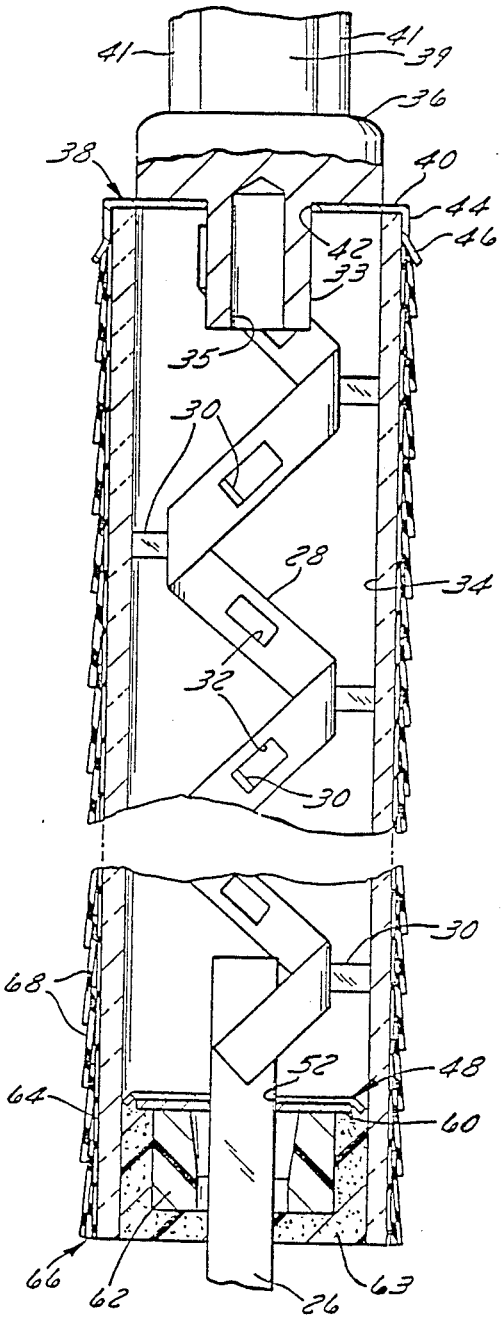
FIG. 3 is a cross-sectional elevation view of the fuse assembly.

The self-supporting ribbon 28 is formed by punching holes 32 at equally spaced distances leaving tabs 30 projecting outwardly from one side of the ribbon. The ribbon is spirally wound on the mandrel shaft 71 of the mandrel assembly 70, as shown in FIG. 2 with the windings equally spaced from each other. The mandrel assembly 70 includes the terminal stud 36 and the centering cup 38. The boss 33 projects through the opening 42 in the cup 38. The mandrel shaft 71 is secured to the boss 33 of the stud 36 by means of a rubber rod 72. The lower end of the rod 72 is permanently mounted in a blind bore 74 provided in the end of shaft 71. The upper portion of the rod 72 is temporarily wedged into the bore 35 provided in the boss 33. After the ribbon 28 has been tightly wrapped on the shaft 71, the upper end of the ribbon is secured to the boss 33 on the stud 36. The lower end of the ribbon 28 is retained by means of a clamp or rubber band 76 which is mounted on the mandrel shaft 71.

The Pyrex glass tubing 34 is then centered on the shaft 71 and pushed into the centering cup 38. The tubing is secured to the centering cup 38 by means of an RTV adhesive. After the tubing has been bonded to the cup 38, the rubber band is removed to release the ribbon and the mandrel shaft is rotated slightly to allow the ribbon 28 to spring outwardly into engagement with the walls of the tubing. The tabs 30 will hold the ribbon in a spaced relation to the walls of the tubing. The mandrel shaft 71 is then pulled out of the tubing 34. As the shaft is pulled out of the ribbon, the portion of the rod 72 in the bore 35 will elongate or stretch reducing the diameter of the rod so that it will be released from the bore 35 in boss 33. The release of the ribbon from the mandrel shaft can be observed through the glass tubing to be sure that the ribbon is fully released from the mandrel shaft and the windings are equally spaced.

The other end of the ribbon is soldered to a brass or copper rod 26. The rod 26 is centered in the tubing by means of a square spring metal washer 48 The tubing 34 is then filled with a granular dielectic material 56 in the form of sand which is poured into the tubing through the spaces between the edges of the square washer 48 and the inside surface of the tubing. After the tubing has been filled with sand, a paper disk 60 is positioned on the square washer 48 to temporarily seal the openings between the washer and the tube. The rod is then sealed in the tubing by means of a spacer 62 and the RTV permanent seal 63 which are inserted into the end of the tubing.

The silicone rubber tape 66 is then wrapped around the outside surface of the tubing to provide the gas-tight covering. The tape is a self-bonding, self-fusing type tape which forms the seal. The reinforced adhesive tape 68 is then wrapped around the silicone rubber tape 66 to increase the burst strength of the tubing 34 and to prevent any ballooning of the silicone layer.

The fuse assembly 10 is inserted into the axial passage 16 in the bushing 12. Means is provided in the counterbore 18 to prevent rotation of the terminal stud 36 in the bushing housing 14. Such means is in the form of a key plug 80 having a central opening 82 and a pair of diametrically opposed slots 84. The key plug is fused in the bore 18. The post 39 of the terminal stud 36 is inserted into the opening 82 in the plug 80 with the flanges 41 aligned in slots 84. The stud 36 is then locked in the plug 80.

The high voltage terminal 22 is screwed onto the threaded section 37 of the post 39 until the gasket 24 is seated on the end of the bushing housing 14. The lower end of the passage 16 is sealed by means of a rubber plug 65 having a passage 78 which is inserted into the passage 16 with the rod 26 extending through the passage 78.

The embodiments of the invention in which an exclusive property or privilege is claimed, are defined as follows:

1. A fused high voltage electric bushing for connecting a high voltage cable to an electrical apparatus within a casing, said bushing comprising a housing formed of a dielectic material and having an axially extending passage, an electric terminal at one end of said passage, a fuse assembly positioned in said passage and being electrically connected to said electric terminal, said fuse assembly including a dielectric tubing, terminal means mounted on one end of said tubing, an electrically conductive ribbon positioned in said tubing, means formed integral with said ribbon for spacing said ribbon inwardly from said tubing, said ribbon being electrically connected to said terminal means, conductive means connected to the other end of said ribbon and extending outwardly from the other end of said tubing, a granular dielectic material completely filling the interior of said tubing, and means for enclosing the other end of said passage with said rod extending outwardly therefrom.

2. The bushing according to claim 1, including means for sealing the outside surface of said tubing to prevent gas leaks on interruption.

3. The bushing according to claim 2, including the means for increasing the burst strength of said tubing to prevent damage to the bushing on interruption of the fuse.

4. The bushing according to claims 1, 2 or 3 wherein said dielectric tubing is formed from glass.

5. A current-limiting fuse comprising a dielectric tubing, electrically conductive terminating means mounted on one end of said tubing, a spirally wound electrically conductive ribbon positioned in said tubing and having an end electrically connected to said terminating means, said ribbon including means for spacing said ribbon inwardly from said tubing, conductive means mounted in the other end of said tubing and connected to the other end of said ribbon, and granular dielectric material completely filling said tubing.

6. The fuse according to claim 5, wherein said tubing is formed of glass.

7. The fuse according to claims 5 or 6, including means for centering said terminating means in said tubing.

8. The fuse according to claims 5 or 6, including means for sealing the outside surface of said tubing to prevent gas leaks on interruption.

9. The fuse according to claims 5 or 6, including means for increasing the burst strength of said tubing.

10. The fuse according to claim 8, including means for increasing the burst strength of said tubing.

11. The fuse according to claim 8 wherein said sealing means comprises a self-bonding, self-fusing, silicone rubber tape wound around the outside of said tubing.

12. The fuse according to claim 9 wherein said strength increasing means comprises a glass reinforced adhesive tape wound around the outside of said tubing.

13. A mandrel assembly for positioning an elongate electrically conductive ribbon in a fuse tubing, said assembly including a terminal stud having a bore in one end, a centering cap mounted on said stud for centering the stud on one end of said tubing, a mandrel shaft for supporting the ribbon, a rubber rod having one end mounted in one end of said shaft and the other end wedged into said bore in said stud, whereby said mandrel shaft and rubber rod can be pulled from said terminal stud after the centering cap has been centered on the tubing.

14. A method for forming a current limiting fuse comprising the steps of forming a terminal stud, removeably mounting a mandrel shaft on said terminal stud, winding a conductive ribbon tightly around the outside of said mandrel shaft, securing one end of said ribbon to said terminal stud, pushing a glass tubing over said shaft into engagement with said terminal stud, rotating the mandrel shaft slightly to release the ribbon from the mandrel shaft, removing said mandrel shaft from said terminal stud, securing a conductive rod to the other end of said ribbon, filling said tubing with a granulated dielectric material and sealing said conductive rod in the end of said tubing.

15. The method according to claim 1 including the step of winding a self-bonding, self-fusing tape around the outside of said tubing.

16. The method according to claims 14 or 15 including the step of winding a reinforced tape around the outside of said tubing.

* * * * *